US007350909B2

(12) United States Patent
Takagi et al.

(10) Patent No.: US 7,350,909 B2
(45) Date of Patent: Apr. 1, 2008

(54) INK CARTRIDGE AND INKJET PRINTER

(75) Inventors: Atsuhiro Takagi, Kariya (JP); Toyonori Sasaki, Anjo (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 368 days.

(21) Appl. No.: 11/065,141

(22) Filed: Feb. 24, 2005

(65) Prior Publication Data

US 2005/0195225 A1 Sep. 8, 2005

(30) Foreign Application Priority Data

Mar. 4, 2004 (JP) ..... 2004-060456
Mar. 15, 2004 (JP) ..... 2004-072689

(51) Int. Cl.
*B41J 2/175* (2006.01)

(52) U.S. Cl. ..... 347/86

(58) Field of Classification Search ..... 347/7, 347/19, 49, 86, 87; 73/1.73, 305
See application file for complete search history.

(56) References Cited

U.S. PATENT DOCUMENTS 5,842,800 A * 12/1998 Bailey et al. ..... 400/703
6,520,612 B1 * 2/2003 Merz et al. ..... 347/7
6,578,941 B2 * 6/2003 Arai et al. ..... 347/7
6,582,068 B2 * 6/2003 Ishizawa et al. ..... 347/85
2005/0024454 A1 2/2005 Hayamizu et al.

FOREIGN PATENT DOCUMENTS

| | | | |
|---|---|---|---|
| EP | 0 779 156 A1 | | 6/1997 |
| EP | 1 097 814 A2 | | 5/2001 |
| EP | 1 177 904 A1 | | 2/2002 |
| JP | 10-128998 | | 5/1998 |
| JP | 10-230616 | | 9/1998 |
| JP | 410235899 | * | 9/1998 |
| JP | B2 2960614 | | 7/1999 |
| JP | 2000-326519 | | 11/2000 |
| JP | 2001-162820 | | 6/2001 |
| JP | 2001-287381 | | 10/2001 |
| JP | 2003-311937 | | 11/2003 |

* cited by examiner

*Primary Examiner*—Anh T. N. Vo
(74) *Attorney, Agent, or Firm*—Oliff & Berridge, PLC

(57) ABSTRACT

An ink cartridge includes a first detection portion positioned on the cartridge so as to be detectable by a detector of an image forming apparatus when the ink cartridge is installed in the image forming apparatus and a second detection portion positioned on the cartridge so as to be detectable by the detector during installation and removal of the ink cartridge into/from the image forming apparatus. The second detection portion is positioned apart from the first detection portion toward a surface of the ink cartridge that is first inserted into the image forming apparatus during installation of the ink cartridge in the image forming apparatus. Image forming apparatuses compatible with such ink cartridges are also provided.

29 Claims, 11 Drawing Sheets

INK CARTRIDGE AND INKJET PRINTER

CROSS-REFERENCE TO RELATED APPLICATIONS

This application claims priority from JP 2004-060456, filed Mar. 4, 2004, and JP 2004-072689, filed Mar. 15, 2004, the disclosures of which are incorporated herein by reference in their entireties.

BACKGROUND

The invention relates to an ink cartridge for containing ink and an inkjet printer for use with the ink cartridge.

A known inkjet printer, in which a translucent ink cartridge containing ink is installed, includes a residual ink amount detecting sensor for detecting an amount of ink remaining in the ink cartridge. An optical sensor is used, including a light emitter that emits light and a light receiver that receives the light emitted from the light emitter that passes through the ink cartridge. Such an arrangement is shown, for example, in FIG. 2 of JP 2960614.

In inkjet printers including such optical sensors, the optical sensors may mistakenly detect that a particular amount of ink remains in an ink cartridge, even when the ink cartridge is not installed in the inkjet printer. When an ink cartridge is removed from the printer, the optical sensor does not detect such removal. Because no determination is made as to whether or not the ink cartridge is installed in the printer, malfunctions in various operations of the printer, such as ink ejection, may result. One possible remedy to this difficulty would involve installing a separate sensor for detecting whether an ink cartridge is installed on a printer. Such a solution, however, would unduly increase the cost of manufacturing the printer.

SUMMARY

In various exemplary embodiments, an ink cartridge includes a first detection portion positioned on the cartridge so as to be detectable by a detector of an image forming apparatus when the ink cartridge is installed in the image forming apparatus and a second detection portion positioned on the cartridge so as to be detectable by the detector during installation and removal of the ink cartridge into/from the image forming apparatus. In various exemplary embodiments, the second detection portion is positioned apart from the first detection portion toward a surface of the ink cartridge that is first inserted into the image forming apparatus during installation of the ink cartridge in the image forming apparatus.

In various exemplary embodiments, an image forming apparatus includes a cartridge mounting portion capable of mounting an ink cartridge including a first detection portion and a second detection portion, a detector capable of detecting the first detection portion when the ink cartridge is installed in the image forming apparatus and detecting the second detection portion during installation and removal of the ink cartridge into/from the image forming apparatus, and a control device that calculates a residual ink amount in the ink cartridge based on detection of the first detection portion by the detector, and determines whether the ink cartridge is mounted on the cartridge mounting portion based on whether the second detection portion is detected by the detector.

In various exemplary embodiments, an ink cartridge includes an ink tank capable of containing ink, an ink supply passage through which ink in the ink tank can be selectively supplied to a location outside of the ink tank, the ink supply passage being capable of engaging with a connecting tube for supplying ink to a print head in an image forming apparatus when the ink cartridge is installed in the image forming apparatus, a first protrusion provided on an outer wall of the ink cartridge, the first protrusion extending along the outer wall in a direction in which ink is supplied to a location outside of the ink tank, and a second protrusion provided on an outer wall of the ink cartridge, the second protrusion extending along the outer wall in the direction in which ink is supplied to a location outside of the ink tank, and being formed from a material that is substantially impermeable to light. In various exemplary embodiments, at least a part of the first protrusion is positioned on the ink cartridge so as to be interposed between a light emitting portion and a light receiving portion of a through-beam sensor provided in the image forming apparatus, when the ink cartridge is installed in the image forming apparatus, and at least a part of the second protrusion is positioned on the ink cartridge so as to pass between the light emitting portion and the light receiving portion during installation and removal of the ink cartridge into/from the image forming apparatus.

In various exemplary embodiments, an inkjet printer includes a print head capable of ejecting ink onto a recording medium, and a cartridge mounting portion capable of mounting an ink cartridge including a first protrusion and a second protrusion. In various exemplary embodiments, the cartridge mounting portion includes a through-beam sensor having a light emitting portion and a light receiving portion, and a connecting tube for supplying ink in the ink cartridge to the print head. In various exemplary embodiments, the cartridge mounting portion is configured so that: during installation of the ink cartridge in the inkjet printer, the second protrusion passes between the light emitting portion and the light receiving portion before the first protrusion; when the cartridge is installed in the inkjet printer, at least a part of the first protrusion is interposed between the light emitting portion and the light receiving portion and at least a part of the connecting tube is engaged with the ink supply passage; and during removal of the ink cartridge from the inkjet printer, the second protrusion passes between the light emitting portion and the light receiving portion after the first protrusion is moved away from a position between the light emitting portion and the light receiving portion.

These and other optional features and possible advantages of various aspects of this invention are described in, or are apparent from, the following detailed description of exemplary embodiments of systems and methods which implement this invention.

BRIEF DESCRIPTION OF THE DRAWINGS

Various exemplary embodiments of the invention will be described in detail with reference to the following figures, wherein.

DETAILED DESCRIPTION OF EMBODIMENTS

Figure 1:
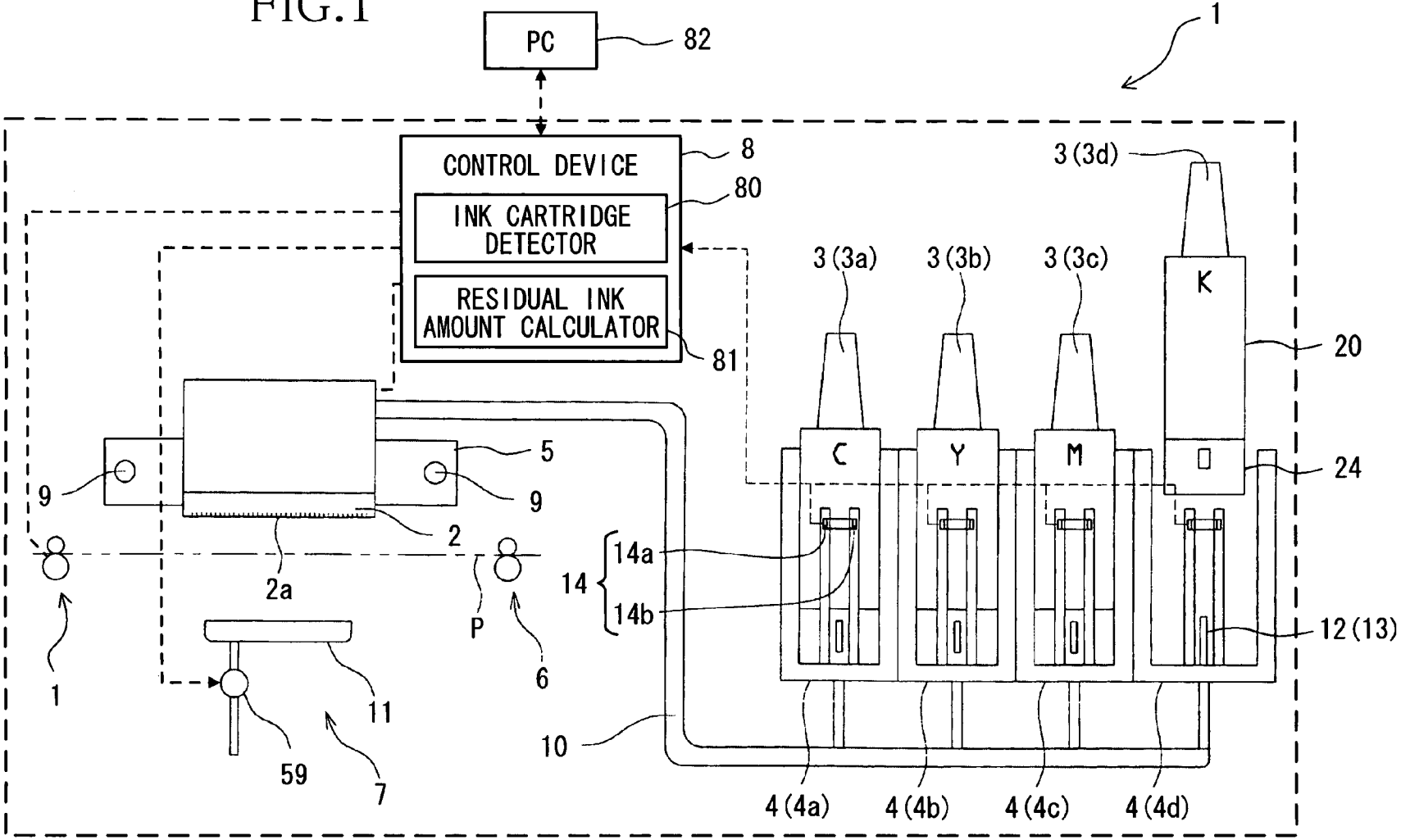
FIG. 1 is a schematic showing an exemplary inkjet printer according to this invention.

Throughout the following description, numerous specific concepts and structures are set forth in order to provide a thorough understanding of the invention. The invention can be practiced without utilizing all of these specific concepts and structures. In other instances, well known elements have not been shown or described in detail, so that emphasis can be focused on the invention.

Various exemplary embodiments include an inkjet printer that can detect a residual ink amount in an ink cartridge and determine whether the ink cartridge is installed in the inkjet printer with a single detector.

An exemplary ink cartridge may include a first detection portion and a second detection portion. The first detection portion may be positioned to be capable of being detected by a detector of an inkjet printer when the ink cartridge is installed in the inkjet printer. The second detection portion may be positioned away from the first detection portion, such that the second detection portion is on a leading side of the first detection portion with respect to a direction that the ink cartridge is installed in the inkjet printer. The second detection portion may be detected by the detector as the ink cartridge is installed or removed from the inkjet printer.

In various exemplary embodiments, when installation of the ink cartridge is complete, the first detection portion may be detected by the detector to detect a residual ink amount in the ink cartridge. During installation or removal of the ink cartridge, the second detection portion may be detected by the detector to detect whether or not the ink cartridge is installed in the inkjet printer. Thus, a residual amount of ink in the ink cartridge and whether the ink cartridge is installed in the inkjet printer may be detected using a single detector. Because the second detection portion may be positioned away from the first detection portion, such that the second detection portion is on a leading side of the first detection portion with respect to a direction that the ink cartridge is installed in the inkjet printer, the second detection portion is not detected by the detector after installation is complete.

In various exemplary embodiments, an inkjet printer may include a detector having a light emitting portion and a light receiving portion. The first detection portion and the second detection portion may be detected by blocking light emitted by the light emitting portion. Thus, a non-contact type detector may be employed to detect a residual ink amount (which varies over time due to consumption), and to determine whether an ink cartridge is installed in the inkjet printer.

In various exemplary embodiments, an ink cartridge may further include a cartridge body that is capable of containing ink therein and that is, at least partially, permeable to light. The first detection portion may be a light shielding plate that does not permit passage of light, and that is disposed in the cartridge body so as to move in response to variations in a residual ink amount in the cartridge body. The light shielding plate and the second detection portion may be disposed along the ink cartridge in a direction in which the cartridge is installed. As the first detection portion may be a light shielding plate that does permit passage of light, and that is disposed in the cartridge body so as to move in response to variations in a residual ink amount in the cartridge body, the residual ink amount, which varies with time due to the consumption of ink, may be detected. Because the second detection portion may be positioned away from the first detection portion along the ink cartridge in a direction in which the cartridge is installed, the second detection portion may be detected by the detector only during installation or removal of ink cartridge in one predetermined direction into or from the inkjet printer. After installation is complete, only the first detection portion is detected by the detector. Thus, installation and removal are simplified by avoiding complicated operations to detect the second detection portion with the detector. By simplifying removal or installation, breakage of an exposed second detection portion, which may be less sturdy than the remainder of the cartridge, as a result of contacting a cartridge mounting portion during installation, can be avoided.

In various exemplary embodiments; an ink cartridge may further include a cartridge body capable of containing ink and a cap that covers an end of the cartridge body on a leading side of the ink cartridge with respect to a direction of installation. The second detection portion may be a protrusion that protrudes outwardly from a side surface of the cap, and that does not permit passage of light. In such a configuration, the second detection portion may be formed as a protrusion of relatively simple structure.

In various exemplary embodiments, an inkjet printer may be capable of accommodating two or more ink cartridges. In such embodiments, the maximum ink capacity of a first cartridge may exceed the maximum ink capacity of a second cartridge. The first and second ink cartridges may include protrusions (e.g., second detection portions) of different shapes. Accordingly, the manner in which the protrusion on the first cartridge is detected by a detector may differ from the manner in which the protrusion on the second cartridge is detected. Thus, the protrusions may be used to determine the maximum ink capacity of an installed ink cartridge. In addition, a residual ink amount in an ink cartridge may be output to an external device, such as a personal computer, based on the detected maximum ink capacity of the ink cartridge.

In various exemplary embodiments, an ink cartridge may include a cartridge body and a cap as separate members. Thus, as the cartridge body and the cap are separate members, the cap may be provided in different shapes determined by the specifications of a particular inkjet printer.

In various exemplary embodiments, an ink cartridge may further include a cover for covering at least a part of a protrusion (e.g., second detection portion). Thus, damage to the protrusion can be prevented when the ink cartridge is installed in or removed from an inkjet printer.

In various exemplary embodiments, an inkjet printer may include: a cartridge mounting portion capable of accommodating an ink cartridge; a detector capable of detecting a first detection portion of the ink cartridge when installation of the ink cartridge is complete and a second detection portion of the ink cartridge during installation or removal of the ink cartridge in/from the inkjet printer; and a control device that calculates a residual ink amount in the ink cartridge based on detection of the first detection portion by the detector and that determines whether the ink cartridge is installed in the cartridge mounting portion based on whether the detector detects the second detection portion.

In various exemplary embodiments, a control device may calculate a residual ink amount in an ink cartridge based on detection of a first detection portion by a detector. The control device may also determine whether the ink cartridge is installed in a cartridge mounting portion based on whether a second detection portion is detected by the detector. Thus, the detector for detecting whether the ink cartridge is installed in the cartridge mounting portion may not have to be separately provided from the detector for detecting the residual ink amount in the ink cartridge. Such a configuration may reduce production costs.

In various exemplary embodiments, an ink cartridge may include an ink tank capable of containing ink and an ink supply passage through which ink in the ink tank can be selectively supplied outside the cartridge. The ink supply passage may be capable of engaging with a connecting tube for supplying ink to a print head provided in an inkjet printer when the cartridge is installed in the inkjet printer. The cartridge may include a first protrusion that extends along the cartridge in a direction that ink flows out of the ink supply passage on an outer wall parallel to the ink outflow direction, and a second protrusion that extends along the cartridge in a direction that ink flows out of the ink supply passage on the outer wall parallel to the ink outflow direction. At least the second protrusion may be at least partially impermeable to light. At least a part of the first protrusion may be interposed between a light emitting portion and a light receiving portion of a through-beam sensor provided in an inkjet printer, when the cartridge is installed in the printer. The light impermeable portion of the second protrusion may pass between the light emitting portion and the light receiving portion during installation and removal of the ink cartridge into/from the inkjet printer.

In various exemplary embodiments, an inkjet printer may include a print head that ejects ink onto a recording medium, and a cartridge mounting portion capable of accommodating an ink cartridge. The cartridge mounting portion may include a through-beam sensor having a light emitting portion and a light receiving portion, and a connecting tube for supplying ink in the ink cartridge to the inkjet print head. At least a part of the connecting tube may be engaged with an ink supply passage of the ink cartridge when the cartridge is installed in the inkjet printer.

In various exemplary embodiments, an ink cartridge may include a protrusion, at least a part which may be capable of being switched between a first state where the part is impermeable to light and a second state where the part is permeable to light. With such a structure, a residual ink amount in an ink tank of the ink cartridge may be reliably detected using a through-beam sensor.

In various exemplary embodiments, an ink cartridge may have a first outer wall and a second outer wall, with a protrusion formed only in the second wall. Such a configuration may result in the ink cartridge having an asymmetrical shape, which prevents incorrect installation of the ink cartridge in an inkjet printer. The ink cartridge may include a pair of ribs extending on the second wall so that the protrusion is situated between the ribs. The ribs may function as guides when the ink cartridge is installed the inkjet printer. Thus, again, incorrect installation of the ink cartridge in the inkjet printer may be prevented.

In various exemplary embodiments, an ink cartridge may include a first protrusion and second protrusion having different widths, such that the protrusion that enters an inkjet printer first upon installation is thinner that the protrusion enters the inkjet cartridge second. By employing such a structure, mounting and removal of the ink cartridge may be readily performed. In some such embodiments, the second protrusion may be thinner than the first protrusion. The second protrusion may be a thin plate member that is impermeable to light. A length of the second protrusion, in a direction perpendicular to a direction in which ink flows out of the cartridge, may be shorter than a length of the first protrusion. By employing such structures, the second protrusion may easily pass through a through-beam sensor. Accordingly, mounting and removal of the cartridge may be easily performed.

In various exemplary embodiments, an ink cartridge may include an ink supply passage having a valve member that opens the ink supply passage when the ink supply passage is engaged with a connecting tube. By employing such a structure, ink leakage from the ink supply passage may be prevented during the use of the ink cartridge.

An exemplary embodiment of the invention will be described in detail below. A color inkjet printer 1 is capable of ejecting four colors of ink. As shown in FIG. 1, the color inkjet printer 1 includes a print head 2, four ink cartridges 3, four holders 4, a carriage 5, a conveying mechanism 6, a purge device 7, and a control device 8. The print head 2 has nozzles 2*a* that eject four colors of cyan (C), yellow (Y), magenta (M), and black (K) ink onto a sheet P. Each of the four ink cartridges 3 (3*a*, 3*b*, 3*c*, 3*d*) contains one of four colors of ink. Each of the four holders 4 (4*a*, 4*b*, 4*c*, 4*d*), as a cartridge holder, mounts a respective ink cartridge 3 thereon. The ink cartridges 3 are respectively mounted on/installed in the holders 4 along a vertical direction that is parallel to the top to bottom direction in FIG. 1. The carriage 5 linearly reciprocates the print head 2 along a guide 9 in a direction perpendicular to the sheet of FIG. 1. The conveying mechanism 6 conveys the sheet P in a direction perpendicular to a moving direction of the print head 2 and parallel to an ink ejection surface. The purge device 7 suctions air or high viscosity ink from the print head 2. The control device 8 performs overall control of the inkjet printer 1.

In the inkjet printer 1, while the print head 2 is reciprocated by the carriage 5 in a direction perpendicular to the page in FIG. 1, the sheet P is conveyed by the conveying mechanism 6, left and right with respect to the page in FIG. 1. In association with the movement of the print head 2, ink is supplied to nozzles 2*a* of the print head 2 from the ink cartridges 3 mounted on/installed in the holders 4, through supply tubes 10. Ink is ejected form the nozzles 2*a* onto the sheet P, to perform printing onto the sheet P.

The purge device 7 includes a purge cap 11 that is movable toward and away from the ink ejection surface of the print head 2, so as to cover or uncover the ink ejection surface, and a suction pump 59 suctions ink from the nozzles 2*a*. When the print head 2 is placed out of a print area where the print head 2 can perform printing on the sheet P, air or high viscosity ink resulting from water evaporation present in the print head 2 can be suctioned from the print head 2 by the purge device 7.

The four holders 4 (4*a*-4*d*) are aligned in a row. The ink cartridges 3*a*-3*d* that contain cyan, yellow, magenta, and black ink are mounted on/installed in the four holders 4*a*-4*d*, respectively.

An ink supply tube 12 and an air introduction tube 13 are positioned at the bottom of the holder 4 at positions corresponding to an ink supply valve 21 and an air introduction valve 22 of the ink cartridge 3, respectively. The holder 4 is provided with an optical sensor 14 (through-beam sensor) for detecting a residual ink amount in the ink cartridge 3. The sensor 14 has a light emitting portion 14*a* and a light receiving portion 14*b* that are disposed substantially at the same height, such that a part of the ink cartridge 3 may be sandwiched therebetween. To determine the residual ink amount in the ink cartridge 3, the sensor 14 detects whether the light emitted from the light emitting portion 14*a* is blocked by a shutter mechanism 23 provided in the ink cartridge 3. The detection result is output to the control device 8.

The ink cartridge 3 will be described in detail below. The ink cartridges 3*a*-3*d* have substantially the same structure.

Figure 2A:
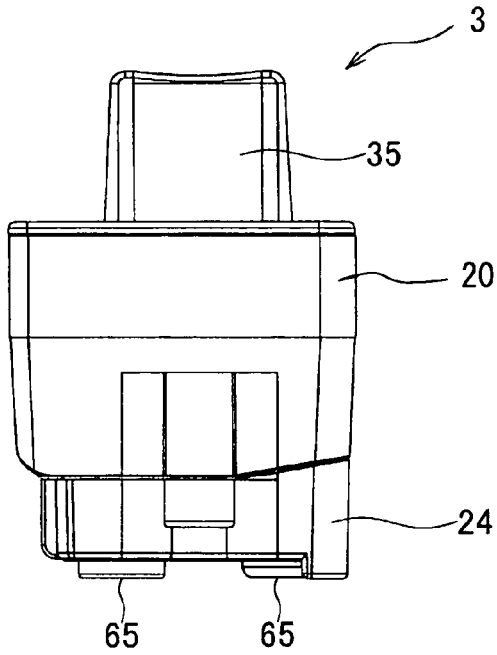
FIG. 2A is a plan view of an exemplary ink cartridge according to this invention.
Figure 2B:
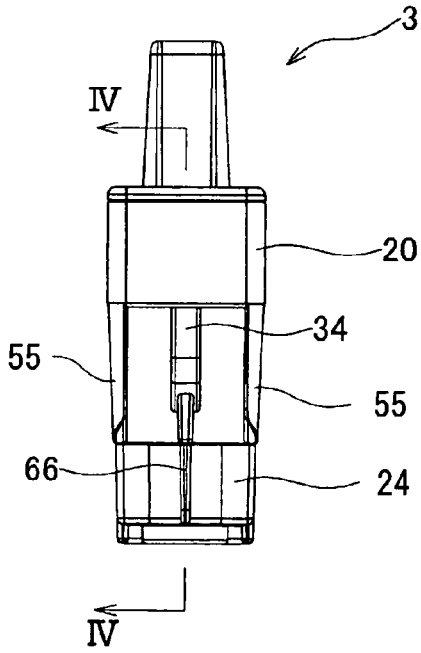
FIG. 2B is a side view of an exemplary ink cartridge according to this invention.
Figure 2C:
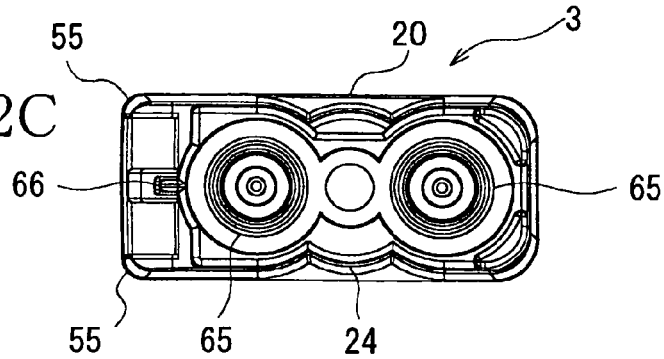
FIG. 2C is a bottom view of an exemplary ink cartridge according to this invention.
Figure 3:
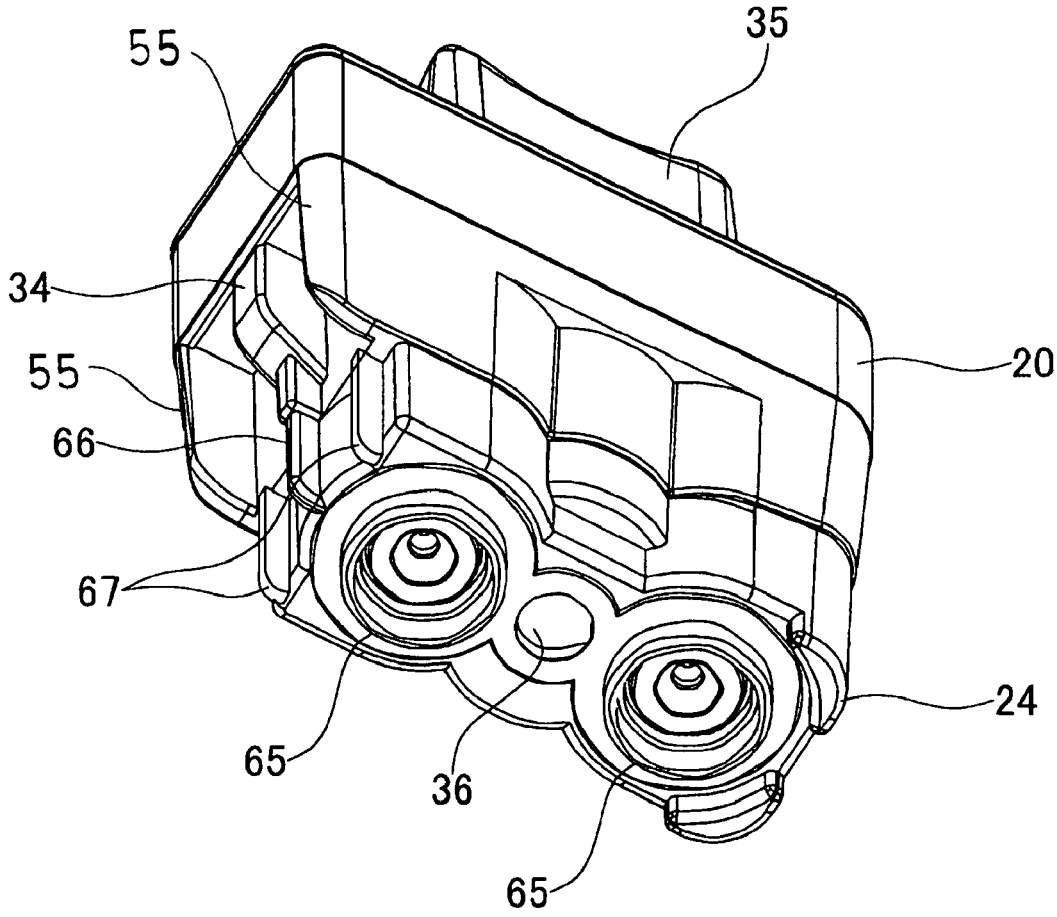
FIG. 3 is a perspective view of the bottom of an exemplary ink cartridge according to this invention.
Figure 4:
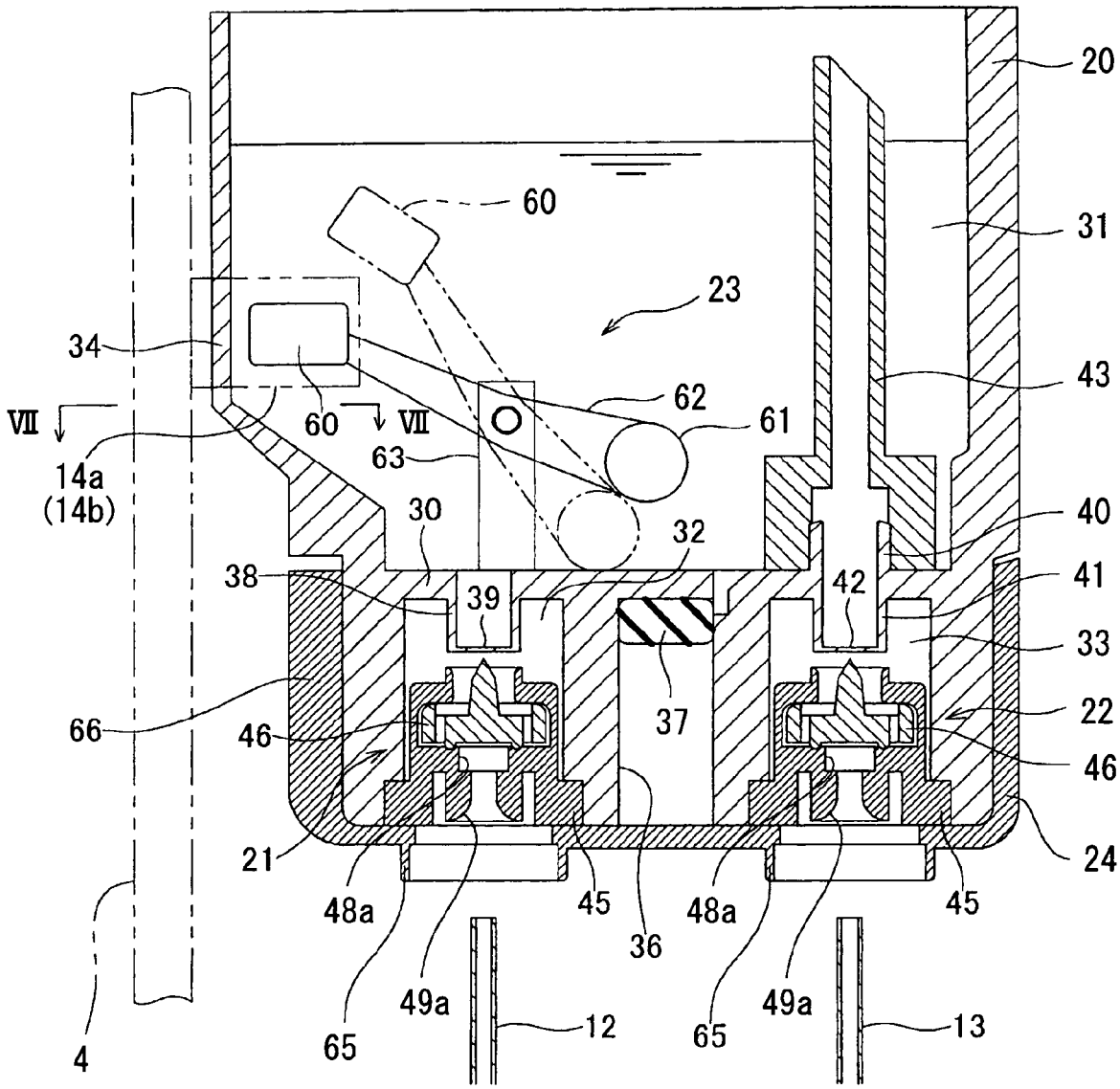
FIG. 4 is a sectional view of the ink cartridge shown in FIG. 2B, taken along the line IV-IV.

As shown in FIGS. 2 to 4, the ink cartridge 3 includes a cartridge body 20 that contains ink, an ink supply valve 21 that opens or closes an ink supply passage for supplying ink from a cartridge body 20 to a print head 2, an air introduction valve 22 that opens or closes an air introduction passage for introducing air into the cartridge body 20, a shutter mechanism 23 that blocks the light emitted from light emitting portion 14*a* of the sensor 14 of the inkjet printer 1 to detect a residual ink amount in the ink cartridge 3, and a cap 24 that covers a lower part of the ink cartridge 3.

Figure 7:
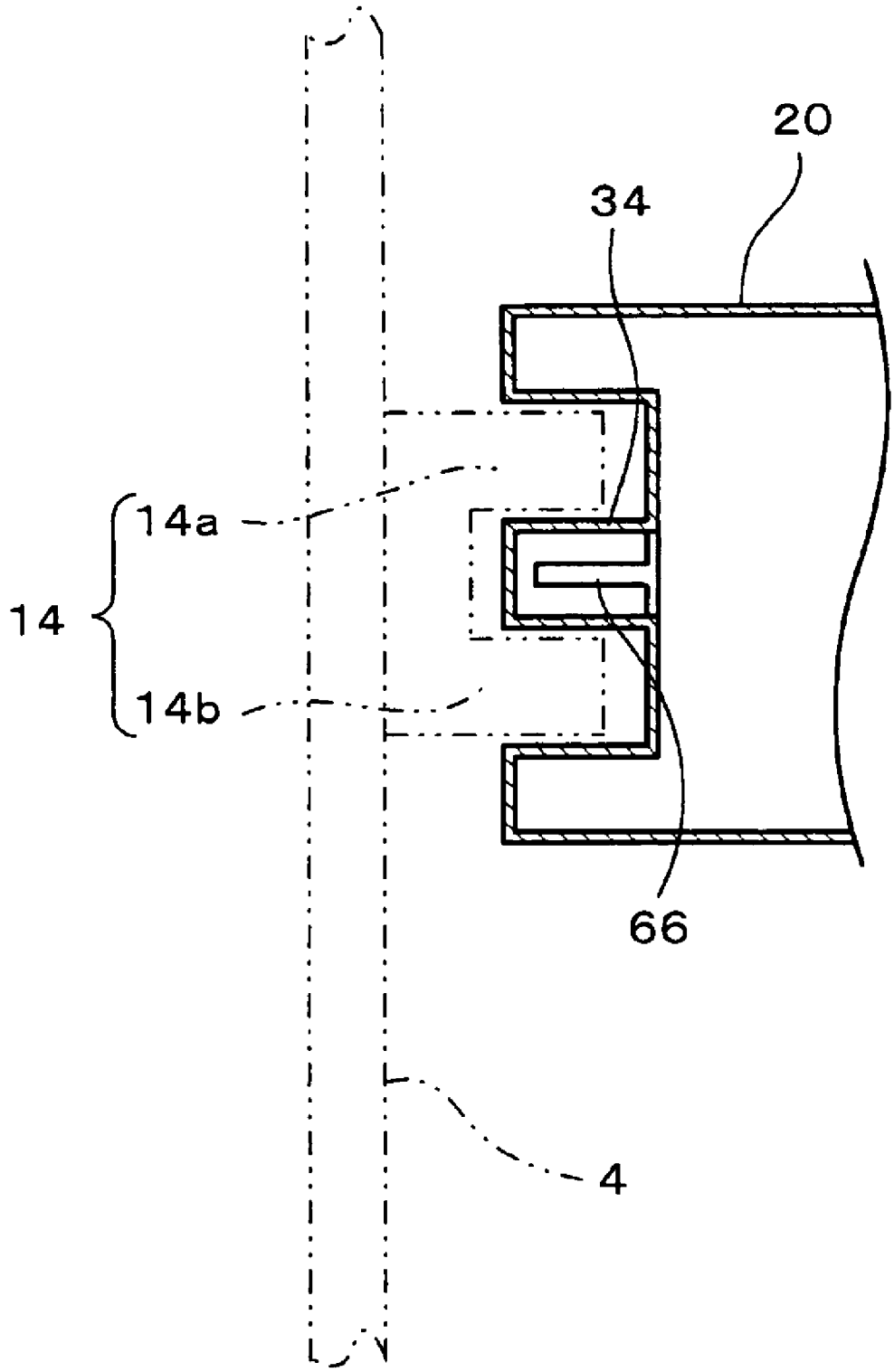
FIG. 7 is a sectional view of the ink cartridge shown in FIG. 4, taken along the line VII-VII.

The cartridge body 20 may be formed of a synthetic resin having light permeability. As shown in FIG. 4, the cartridge body 20 is integrally formed with a partition wall 30 that extends substantially horizontally. The interior of the cartridge body 20 is divided by the partition wall 30 into an ink chamber (ink tank) 31 disposed above the partition wall 30, and valve chambers 32, 33 disposed below the partition wall 30. The ink chamber 31 is filled with ink of one color. The valve chambers 32, 33 accommodate the ink supply valve 21 and the air introduction valve 22, respectively. Formed in the valve chamber 32 is the ink supply passage for dispensing ink from the ink chamber 31 to a location outside the ink cartridge 3. In the ink supply passage, ink flows downward from the ink chamber 31, as shown in FIG. 5B. As shown in FIGS. 2B and 2C, a protrusion 34 that projects slightly outward and extends downward, is formed on a side wall of the ink cartridge 3 at a substantially central portion with respect to a height direction of the ink cartridge 3. A light shielding plate 60 of the shutter mechanism 23 is disposed in an inner space of the protrusion 34. When the ink cartridge 3 is mounted on/installed in the holder 4, the protrusion 34 is positioned between the light emitting portion 14*a* and the light receiving portion 14*b*, as shown in FIG. 7. The width of the protrusion 34 is smaller than the distance between the light emitting portion 14*a* and the light receiving portion 14*b*, so that a predetermined distance is provided between the protrusion 34 and the light emitting portion 14*a*/light receiving portion 14*b*. Provided on edges of the side wall of the ink cartridge 3, where the protrusion 34 is formed, with respect to the horizontal direction, are a pair of ribs 55 that extend parallel to the protrusion 34, so as to interpose the protrusion 34 between the ribs 55. A tapered portion is formed on the rib 55 to guide an opposing side wall of the holder 4 when the ink cartridge 3 is mounted on/installed in the holder 4. A cap member 35 is welded on an upper portion of the cartridge body 20. The ink chamber 31 in the cartridge body 20 is closed by the cap member 35.

An ink filling hole 36 for filling ink into the empty ink chamber 31 of the ink cartridge 3 is disposed between the valve chambers 32, 33. A stopper 37 formed of synthetic rubber is fitted in the ink filling hole 36. An upper end of the ink filling hole 36 in FIG. 4 communicates with the ink chamber 31 in the cartridge body 20. Ink is filled into the ink chamber 31 by inserting an ink filling needle (not shown) into the stopper 37 in the ink filling hole 36.

A cylindrical portion 38 that extends downward is integrally formed with the partition wall 30 at a ceiling portion of the valve chamber 32 accommodating the ink supply valve 21. Disposed at a lower end of the cylindrical portion 38 is a thin film portion 39 that blocks a communication passage formed in the cylindrical portion 38. Cylindrical portions 40, 41 that extend upward and downward are integrally formed with the partition wall 30 at a ceiling portion of the valve chamber 33 accommodating the air introduction valve 22. Disposed at a lower end of the lower-side cylindrical portion 41 is a thin film portion 42 that blocks a communication passage formed in the cylindrical portions 40, 41. A cylindrical member 43 that extends to an upper end of the ink chamber 31 is disposed above the cylindrical portions 40.

Figure 5A:
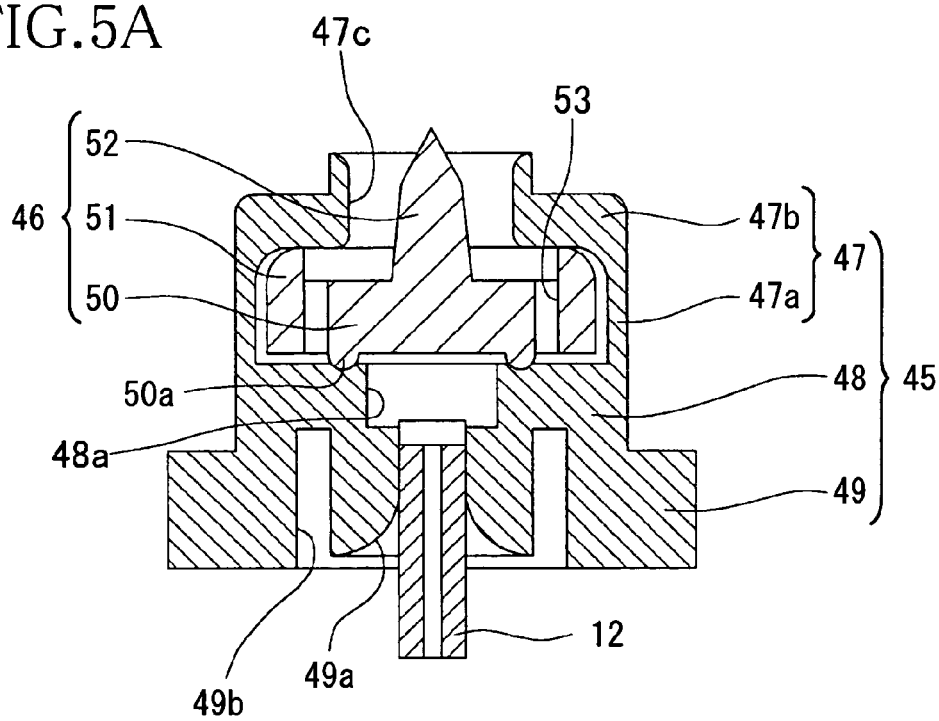
FIG. 5A is a sectional view of an exemplary ink supply valve according to this invention, in which the valve is closed.
Figure 5B:
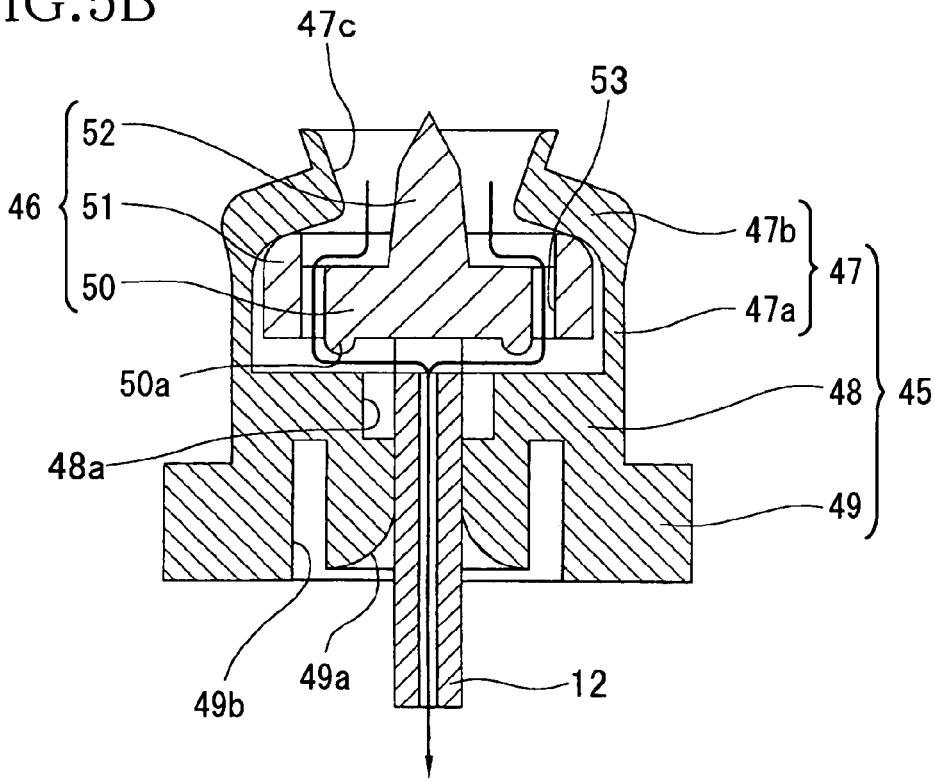
FIG. 5B is a sectional view of an exemplary ink supply valve according to this invention, in which the valve is open.

As shown in FIGS. 4, 5A and 5B, the ink supply valve 21 includes a valve case 45 and a valve body 46 that are formed of, for example, a synthetic rubber having elasticity. The valve body 46 is accommodated in the valve case 45. The valve case 45 is integrally formed with an urging portion 47, a valve seat 48 and an engagement portion 49 that are disposed in this order from the upper side in FIGS. 5A and 5B (from the side of the ink chamber 31).

A lower end of the valve body 46 contacts an upper face of the valve seat 48 (at an end closer to the ink chamber 31). The valve seat 48 is formed with a through hole 48*a* that extends vertically at an axis portion of the valve seat 48. An introduction opening 49*a* that communicates with the through hole 48*a* and extends downward is formed on the engagement portion 49. The introduction opening 49*a* broadens toward the lower side in FIGS. 5A and 5B, so that a diameter of the introduction opening 49*a* on its lower side is greater than that on its upper side. A ring-shaped groove 49*b* is formed so as to enclose the introduction opening 49*a*. A wall defining the introduction opening 49*a* can be readily elastically deformed in such a direction that the diameter of the introduction opening 49*a* is widened. Accordingly, when an ink supply tube 12 is inserted into the introduction opening 49*a*, the introduction opening 49*a* and the ink supply tube 12 can make intimate contact with each other, so that ink leakage can be prevented. Even when the ink supply tube 12 is inserted into the introduction opening 49*a* improperly or at an angle, the wall defining the introduction opening 49*a* can deform such that the diameter of the introduction opening 49*a* is widened, to permit the ink supply tube 12 to be fitted in the introduction opening 49*a*.

The urging portion 47 includes a side wall 47*a* of a substantially cylindrical shape that extends toward the ink chamber 31 from an outer surface of the valve seat 48, and an extended portion 47*b* that is integrally formed with the side wall 47*a* so as to extend inwardly from an upper end of the side wall 47*a* in a radial direction of the urging portion 47. An undersurface of the extended portion 47*b* contacts the valve body 46. With the elasticity of the side wall 47*a* and the extended portion 47*b*, the valve body 46 is urged downwardly. An opening 47*c* is formed on an inner side of the extended portion 47*b*, to allow the side wall 47*a* and the extended portion 47*b*, which are integrally formed, to readily elastically deform.

Figure 6:
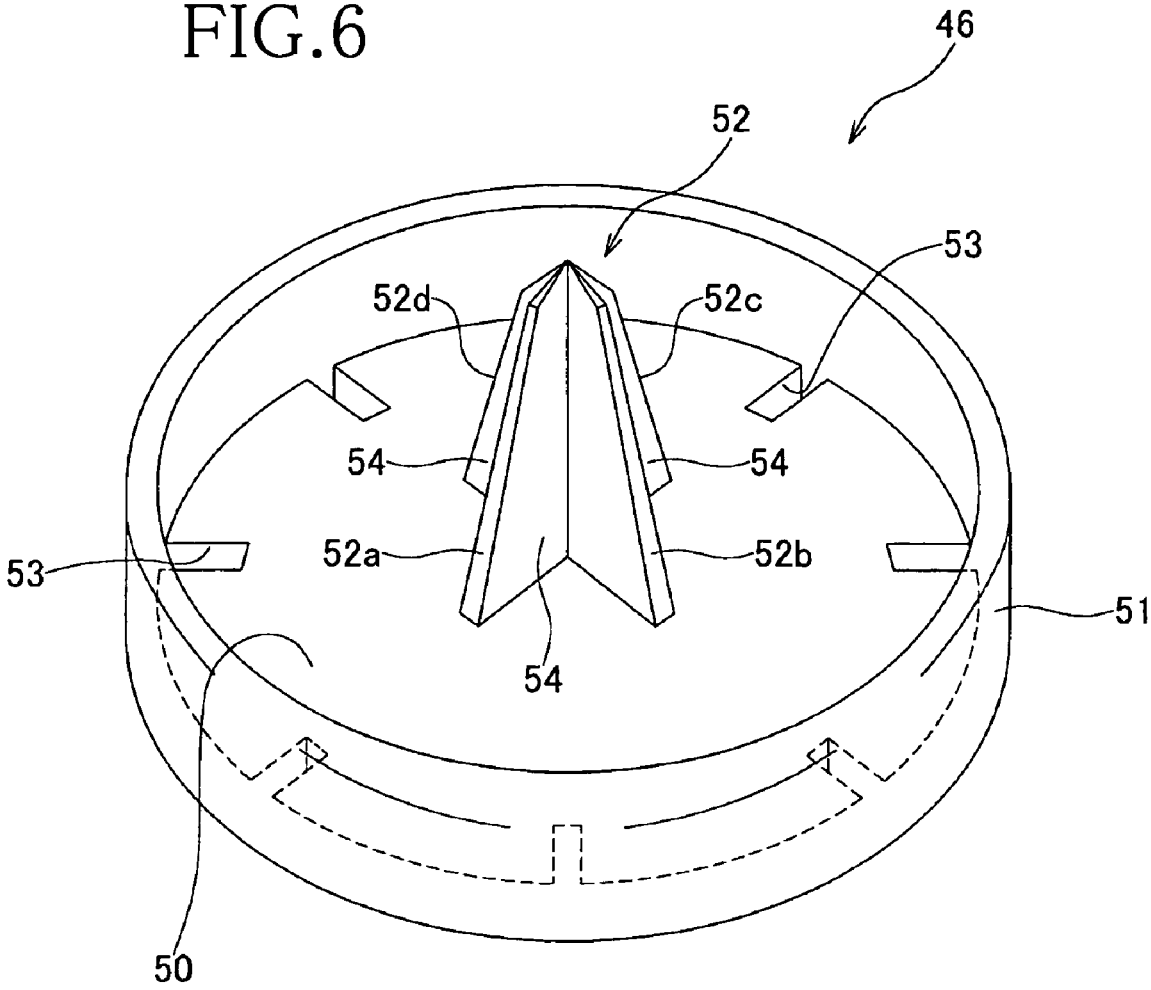
FIG. 6 is a perspective view of the ink supply valve shown in FIGS. 5A and 5B.

As shown in FIGS. 5A, 5B and 6, the valve body 46 includes a bottom 50 that contacts the valve seat 48, a valve body side wall 51 of substantially cylindrical shape that extends toward the ink chamber 31 from the periphery of the bottom 50, and a film breaking part 52 that protrudes toward the ink chamber 31 higher than the valve body side wall 51 from a substantially central portion of the bottom 50.

A ring-shaped protrusion 50*a* that protrudes toward the valve seat 48 is formed on an underside of the bottom 50, which faces the valve seat 48. The valve body 46 is urged by the urging portion 47 toward the valve seat 48. With the ring-shaped protrusion 50*a* making intimate contact with the upper face of the valve seat 48, the through hole 48*a* of the valve seat 48 is closed by the valve body 46, as shown in FIG. 5A. Thus, the ink supply passage is closed. A plurality of communication paths 53 is formed on a part of the bottom 50 outside the ring-shaped protrusion 50*a* but inside the valve body side wall 51, at positions where the perimeter of the bottom 50 is equally divided. For example, eight communication paths 53 are formed on the bottom 50 in the embodiment.

As shown in FIGS. 5A, 5B and 6, the film breaking part 52 includes four plate members 52*a*-52*d* that are put together substantially in the form of a cross in plan view. The film breaking part 52 stands at a substantially central portion of the bottom 50. A vertically extending groove 54 is provided between the adjacent plate members 52*a*-52*d*. The film breaking part 52 protrudes upwardly through the opening 47*c* formed on the inner side of the extended portion 47*b*. The tip of the film breaking part 52 is positioned slightly lower than the thin film portion 39, as shown in FIG. 4.

When the ink cartridge 3 is mounted on/installed in the holder 4, the ink supply tube 12 provided on the holder 4 is inserted into the introduction opening 49*a*, so that the valve body 46 is lifted by the tip of the ink supply tube 12, against the urging force of the urging portion 47, as shown in FIG. 5B. Thus, the valve body 46 moves up while deforming the urging portion 47, so that the ring-shaped protrusion 50*a* of the valve body 46 moves away from the valve seat 48. At this time, the film breaking part 52 of the valve body 46, which has moved up, breaks the thin film portion 39 with its tip. Accordingly, ink in the ink chamber 31 flows into the valve chamber 32, though the communication passage formed in the cylindrical portion 38, as shown in FIGS. 4 and 5B. Then, ink flows in the communication paths 53 of the valve body 46 toward the print head 2, through the ink supply tube 12. At this time, the valve chamber 32 functions as an ink supply passage and ink flows downwardly from the ink chamber 31 through the valve chamber 32.

The air introduction valve 22 includes a valve case 45 and a valve body 46 accommodated in the valve case 45. The air introduction valve 22 has substantially the same structure as the ink supply valve 21. That is, the valve body 46 urged downward by the urging portion 47 makes intimate contact with the valve seat 48 of the valve case 45, such that the valve body 46 closes the through hole 48*a*. When the ink cartridge 3 is mounted on/installed in the holder 4, the air introduction tube 13 is inserted into the introduction opening 49*a* formed in the valve case 45. Similar to the ink supply valve 21, the valve body 46 of the air introduction valve 22 is moved up, and the thin film portion 42 of the cylindrical portion 41 is broken by the film breaking part 52. Consequently, air flows into the valve chamber 33 from the air introduction tube 13, through the communication paths 53 of the valve body 46. Air is introduced to an upper portion of the ink chamber 31, through the inner passage of the cylindrical portions 40, 41 and the cylindrical member 43.

As shown in FIG. 4, the shutter mechanism 23 is disposed at a lower part of the ink chamber 31. The shutter mechanism 23 includes a light shielding plate 60 that is, at least in part, impermeable to light, a hollow float 61, a link member 62 that links the light shielding plate 60 and the float 61, and a supporter 63 that is disposed on an upper face of the partition wall 30 and pivotally supports the link member 62. The link member 62 is provided with the light shielding plate 60 at one end of the link member 62 and the float 61 at the other end of the link member 62. The link member 62 is disposed so as to pivot about a pivot point provided on the supporter 63 in a vertical plane, which is parallel to the sheet of FIG. 4.

The light shielding plate 60 is a thin plate member that has a predetermined area and is disposed in the vertical plane parallel to the sheet of FIG. 4. With the ink cartridge 3 mounted on/installed in the holder 4, the light emitting portion 14*a* and the light receiving portion 14*b* of the sensor 14 provided on the holder 4 are placed at substantially the same height as the protrusion 34 formed on the side wall of the cartridge body 20. When the light shielding plate 60 is disposed in an inner space of the protrusion 34, the light shielding plate 60 blocks light from passing from the light emitting portion 14*a* through the wall of the translucent cartridge body 20 and the ink in the ink chamber 31. The float 61 is of a substantially cylindrical shape with its interior filled with air. The specific gravity of the entire float 61 is smaller than that of ink in the ink chamber 31.

In a state where the amount of ink remaining in the ink chamber 31 is large and the float 61 provided at one end of the link member 62 is submerged in ink, the light shielding plate 60 provided at the other end of the link member 62 is placed in the protrusion 34 at a position that will block light emitted from the light emitted portion 14*a*, as shown by the solid line in FIG. 4, due to the buoyancy of the float 61.

In a state where the amount of ink remaining in the ink chamber 31 is reduced and a part of the float 61 is above the surface of the ink in the ink chamber 31, the float 61 is in a lower position corresponding to the lower position of the surface of the ink. Accordingly, the light shielding plate 60 is moved to a position above the protrusion 34 so that the light shielding plate 60 will not block light emitted by the light emitting portion 14*a*, as shown by the broken line in FIG. 4. Therefore, light from the light emitting portion 14*a* passes through the protrusion 34 in a substantially straight optical path, and is received by the light receiving portion 14*b*. Thus, the sensor 14 detects that the amount of ink remaining in the ink chamber 31 is small.

Unlike the cartridge body 20, the cap 24 is formed of material that does not have light permeability. As shown in FIGS. 2A through 4, the cap 24 is fixed to the cartridge body 20, for example, by ultrasonic welding while covering the lower portion of the cartridge body 20. Circular projections 65 are formed on the bottom of the cap 24 at positions corresponding to the ink supply valve 21 and the air introduction valve 22. When the ink cartridge 3 is placed on, for example, a desk, ink adhered in the vicinity of a port or the introduction opening 49*a* of the ink supply valve 21 or the air introduction valve 22, is not likely to attach to the desk, due to the circular projections 65.

The cap 24 has a rib-like protrusion 66 formed on a side wall thereof on the same side as the protrusion 34 formed on the cartridge body 20. The protrusion 66 extends vertically in a direction that ink flows out of the cartridge body 20. As shown in FIGS. 2B and 4, the protrusion 66 and the light shielding plate 60 placed in the inner space of the protrusion 34 of the cartridge body 20 are disposed apart at a predetermined distance in the vertical direction (the direction that ink flows out of the cartridge body 20 or in the direction the ink cartridge 3 is mounted on/installed in the holder 4), with the protrusion 66 in a position lower than the position of the light shielding plate 60. In other words, the protrusion 66 is disposed at a position away from the light shielding plate 60 toward a leading side of the ink cartridge, with respect to the direction in which the ink cartridge 3 is installed in the cartridge holder 4 (toward a surface of the ink cartridge 3 that is first inserted into the cartridge holder 4 during installation of the ink cartridge 3 in the cartridge holder 4). With the ink cartridge 3 mounted on/installed in the holder 4, the protrusion 66 is positioned in a lower position than the light emitting portion 14*a* and the light receiving portion 14*b* of the sensor 14. As shown in FIG. 7, the protrusion 66 is placed in a position sandwiched between the light emitting portion 14*a* and the light receiving portion 14*b* in a top view of the ink cartridge 3. The width of the protrusion 66 is smaller than that of the protrusion 34. The protruding distance of the protrusion 66 is also smaller than that of the protrusion 34.

Only during installation and removal of the ink cartridge 3 into/from the holder 4, does the protrusion 66 pass between the light emitting portion 14*a* and the light receiving portion 14*b* to block light emitted by the light emitting portion 14*a*. Thus, during installation the protrusion 66 is detected by the sensor 14. In a state where mounting/installation of the ink cartridge 3 on/in the holder 4 is complete, the protrusion 66 is not detected by the sensor 14, but rather the light shielding plate 60 disposed in the protrusion 34 is detected by the sensor 14. More specifically, when the ink cartridge 3 is mounted on/installed in or removed from the holder 4, the sensor 14 detects the protrusion 66. Thus, the control device 8 determines whether the ink cartridge 3 is mounted on/installed in the holder 4. The protrusion 66 is detected by the sensor 14 only when the ink cartridge 3 is mounted (installed) or removed in one direction. Therefore, complicated operations for detecting the protrusion 66 by the sensor 14 are not required. Further, the breakage of the exposed protrusion 66, which may have less structural strength than the protrusion 34, for example by contacting the holder 4 when the ink cartridge 3 is mounted/installed thereon, can be prevented.

The cap 24 is a separate member from the cartridge body 20. Therefore, the cap 24 of the ink cartridge 3 may be formed in different shapes corresponding to the particular specifications of an inkjet printer 1. For example, as shown in FIG. 3, a rib 67 that extends vertically is formed on the cap 24 of the ink cartridge 3 at each end side of the protrusion 66 with respect to the width direction thereof. In association with the ribs 67, grooves (not shown) that engage with the ribs 67 may be formed on the holder 4. The ink cartridge 3 having the ribs 67 on the cap 24 can only be mounted on/installed in the inkjet printer 1 configured to receive such a cap 24. A plurality of different combinations between the cartridge body 20 and the cap 24 may be achieved by changing the shape, the number, and positions of the ribs 67. Thus, an ink cartridge 3 having particular specifications can be mounted on/installed in an inkjet printer 1 with corresponding specifications.

The control device 8 is described in detail below. The control device 8 controls the various operations of the inkjet printer 1, such as ink ejection from the nozzles 2*a* of the print head 2, sheet feeding toward the print head 2, and sheet discharge after printing with the print head 2. The control device 8 includes a central processing unit (CPU), a read-only memory (ROM) that stores programs performed by the CPU and data for use in the programs, a random-access memory (ROM) that temporarily stores data during execution of programs, a non-volatile memory, such as an electrically erasable programmable read-only memory (EEPROM), an input/output interface, and a bus. As shown in FIG. 1, the control device 8 controls units or devices of the inkjet printer 1, such as the print head 2, a motor of the conveying mechanism 6 for driving the carriage 5, and the suction pump 59 of the purge device 7, based on various signals input from an external device, such as a personal computer (PC) 82.

The control device 8 functions as an ink cartridge detector 80 that detects whether the ink cartridge 3 is mounted on/installed in the holder 4 based on a signal output from the sensor 14, and a residual ink amount calculator 81 that calculates an amount of ink remaining in the ink chamber 31.

Figure 8:
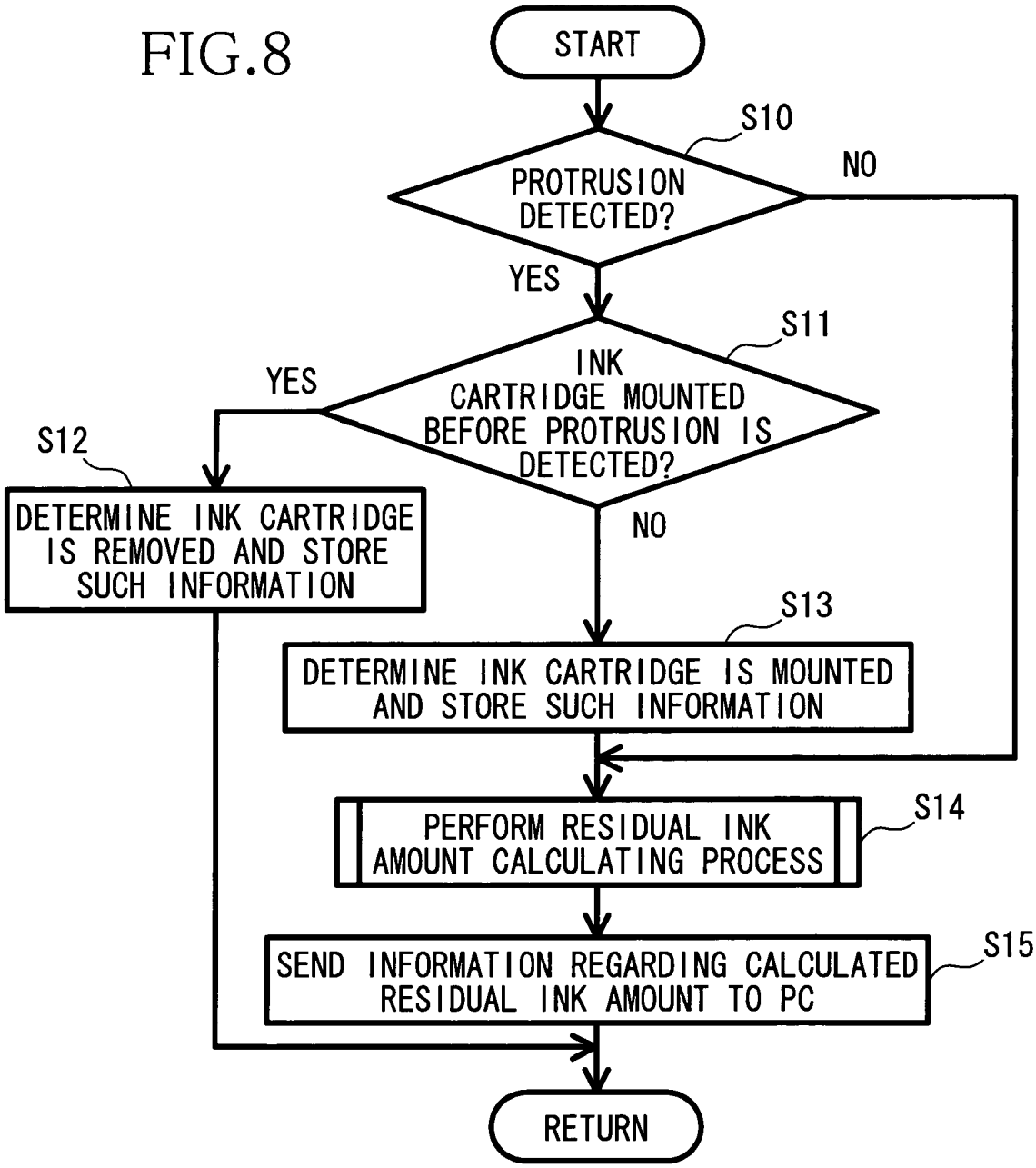
FIG. 8 is a flowchart showing an exemplary process according to this invention for detecting whether an ink cartridge is installed in an inkjet printer.

With reference to the flowchart in FIG. 8, operations of the ink cartridge detector 80 and the residual ink amount calculator 81 will be described.

In the state where the inkjet printer 1 is turned on, when the protrusion 66 provided on the cap 24 is not detected by the sensor 14 (S10: NO), operation proceeds to S14 where a residual ink amount calculating process is performed. When the protrusion 66 is detected by the sensor 14 (S10: YES), operation proceeds to S11 where it is determined whether the ink cartridge 3 is mounted on/installed in the holder 4 before the protrusion 66 is detected by the sensor 14 in step S10. When the ink cartridge 3 is mounted on/installed in the holder 4 before the protrusion 66 is detected by the sensor 14 (S11: YES), it is determined that the ink cartridge 3 is removed from the holder 4 and such information is stored in the control device 8, in step S12. Then, operation returns to START, because the residual ink amount does not have to be calculated.

When the ink cartridge 3 is not mounted on/installed in the holder 4 before the protrusion 66 is detected by the sensor 14 in step 10 (S11: NO), it is determined that the ink cartridge 3 is mounted on/installed in the holder 4 and such information is stored in the control device 8, in step S13. Then, operation proceeds to S14 where the residual ink amount calculating process is performed.

In the residual ink amount calculating process S14, when the residual ink amount in the ink chamber 31 is sufficient and the light shielding plate 60 of the shutter mechanism 23 is detected by the sensor 14, the residual ink amount in the ink chamber 31 is estimated based on the maximum ink containable capacity of the ink cartridge 3 and the total number of ink droplets ejected since the ink cartridge 3 was mounted on/installed in the holder 4. When the residual ink amount in the ink chamber 31 is small and the light shielding plate 60 of the shutter mechanism 23 is not detected by the sensor 14, the residual ink amount in the ink chamber 31 is more precisely calculated, based on the residual ink amount at the time when the light shielding plate 60 becomes undetected by the sensor 14 and the total number of ink droplets ejected since the light shielding plate 60 becomes undetected by the sensor 14. Information regarding the residual ink amount calculated in step 14 is sent to the PC 82 in step 15 and operation returns to START.

Information regarding whether the ink cartridge 3 is mounted on/installed in the holder 4 and the total number of ink droplets ejected is stored in the non-volatile memory, such as EEPROM, to maintain the information after the inkjet printer 1 is turned off.

In the above-described embodiment, the condition of whether the ink cartridge 3 is mounted on/installed in the holder 4 and the residual ink amount in the ink chamber 31 can be detected using one sensor 14. The sensor 14 detects the position of the light shielding plate 60 that moves according to the residual ink amount in the ink chamber 31. The residual ink amount in the ink chamber 31 can be precisely calculated, based on the residual ink amount detected at the time when the light shielding plate 60 becomes undetected by the sensor 14.

The protrusion 34 is formed only on one side wall of the ink cartridge 3, making the ink cartridge 3 asymmetrical. Thus, improper setting of the ink cartridge 3 on the holder 4 can be prevented.

When the ink cartridge 3 is mounted on/installed in the holder 4, the ribs 55 function as guides for guiding an opposing side wall of the holder 4. Thus, the ink cartridge 3 can be properly mounted on/installed in the holder 4.

A predetermined distance is maintained between the protrusion 34 and the light emitting portion 14*a*/the light receiving portion 14*b*, so that the ink cartridge 3 can be readily mounted on/installed in or removed from the holder 4.

The width of the protrusion 66 is smaller than that of the protrusion 34. The protruding distance of the protrusion 66 is also shorter than that of the protrusion 34. Accordingly, the ink cartridge 3 can be readily mounted on/installed in or removed from the holder 4.

The ink cartridge 3 is provided with the ink supply valve 21 that opens with the ink supply tube 12 inserted into ink cartridge 3, so that ink leakage from the ink supply tube 12 when the cartridge 3 is mounted on/installed in the holder 4 can be prevented.

In the above-described embodiment, the light shielding plate 60 is moved as the link member 62 moves according to the residual ink amount in the ink chamber 31. However, the light shielding plate 60 may be moved by directly attaching the light shielding plate 60 to the float floating on ink.

The protrusion 34 is formed on one side wall of the ink cartridge 3. However, another protrusion having substantially the same shape as the protrusion 34 may be formed on the opposite side wall of the ink cartridge 3. In this case, it is preferable that the ink cartridge 3 be mounted on/installed in the holder 4 properly regardless of whether the ink cartridge 3 is oriented in the opposite direction.

The ribs 55 functioning as guides may be eliminated.

When the ink cartridge 3 is mounted on/installed in the holder 4, a predetermined distance is maintained between the protrusion 34 and the light emitting portion 14*a*/the light receiving portion 14*b*. However, the protrusion 34 may be disposed so as to make intimate contact with the light emitting portion 14*a* and the light receiving portion 14*b*.

The width of the protrusion 66 is smaller than that of the protrusion 34. The protruding distance of the protrusion 66 is shorter than that of the protrusion 34. The shape of the protrusion 66 may be changed, as long as the protrusion 66 can pass between the light emitting portion 14*a* and the light receiving portion 14*b*. For example, the protrusion 66 may have the same width as the protrusion 34 or have a wider width than the protrusion 34. The protrusion 66 may have the same protruding distance as the protrusion 34 or have a longer protruding distance than the protrusion 34.

The rib-like protrusion 66 is formed on a side wall of the cap 24 along an extending direction of the protrusion 34 formed on the cartridge body 20 in the embodiment described above. However, different manners for detecting, by the inkjet printer 1, whether the ink cartridge 3 is mounted on/installed in the holder 4 may be employed, without limiting to the use of the protrusion 66. For example, a light shielding member formed of a thin plate may be provided along the extending direction of the protrusion 34, either on the cartridge body 20 or the cap 24, such that the light shielding member is detected by the sensor 14 prior to the protrusion 34 when the ink cartridge 3 is mounted on/installed in the holder 4, and also detected by the sensor 14 when the ink cartridge 3 is removed from the holder 4. The material of the light shielding member may be any material that is impermeable to light. The light shielding member may be fixed by an conventional technique, such as thermal welding or the use of adhesives.

The ink supply valve 21 is provided in the valve chamber 32. However, without disposing the ink supply valve 21 in the valve chamber 32, the chamber 32 may be sealed by an elastic member or a sealing member. In this case, as the ink cartridge 3 is mounted on/installed in the holder 4, the ink supply tube 12 may inserted into the elastic member or the sealing member.

A further embodiment will be described below. It is to be noted that similar reference numerals denote similar elements. The embodiment described above employs ink cartridges 3*a*-3*d*, each having substantially the same structure and capacity. In the embodiment described below, ink cartridges 3*a*-3*c* for color ink and an ink cartridge 3*d*' for black ink are employed, the ink cartridge 3*d*' having a larger capacity than the ink cartridges 3*a*-3*c*. The large ink cartridge 3*d*' may be desired since black ink tends to be used more frequently than other colors, such as cyan, yellow and magenta ink. If, in the inkjet printer 1, the large ink cartridge 3*d*' is constantly mounted on/installed in the holder 4 and not frequently used, ink in the ink cartridge 3*d*' will be left unused for a long period of time, resulting in deterioration of the ink. Accordingly, the inkjet printer 1 may be structured such that the holder 4*d* shown in FIG. 1 can selectively mount thereon the ink cartridge 3*d* having the same capacity as the ink cartridges 3*a*-3*c*, or the large ink cartridge 3*d*' (in FIGS. 9A and 9B).

Figure 9A:
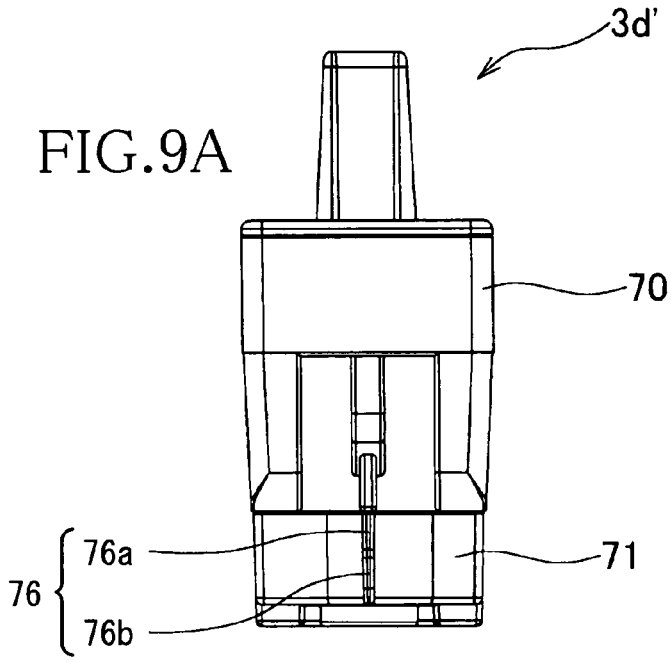
FIG. 9A is a side view of an exemplary ink cartridge according to this invention.
Figure 9B:
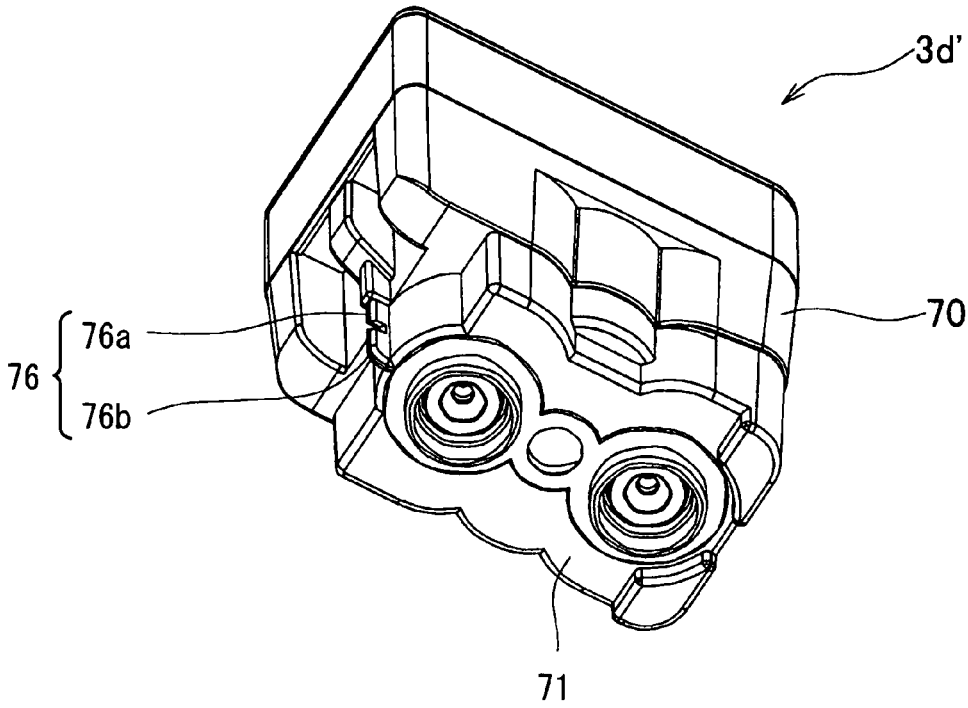
FIG. 9B is a perspective view of the bottom of an exemplary ink cartridge according to this invention.

As shown in FIGS. 9A and 9B, the large ink cartridge 3*d*' includes a cartridge body 70 and a cap 71 that covers a lower part of the cartridge body 70. A protrusion 76 is formed on the cap 71. The protrusion 76 is of substantially a fork shape with detection portions 76*a*, 76*b* vertically aligned. The detection portions 76*a*, 76*b* are substantially impermeable to light. When the ink cartridge 3*d* with smaller capacity is mounted on/installed in or removed from the holder 4, the light emitted from the light emitting portion 14*a* is blocked once by the protrusion 66. When the large ink cartridge 3*d*' is mounted on/installed in or removed from the holder 4, the light from the light emitting portion 14*a* is blocked twice by the detection portions 76*a*, 76*b* of the protrusion 76. Thus, the control device 8 can detect which of ink cartridges 3*d* and 3*d*' is mounted on/installed in the holder 4, based on the number of times that the light from the light emitting portion 14*a* is blocked (the number of times that the protrusion 66 or 76 is detected).

Figure 10:
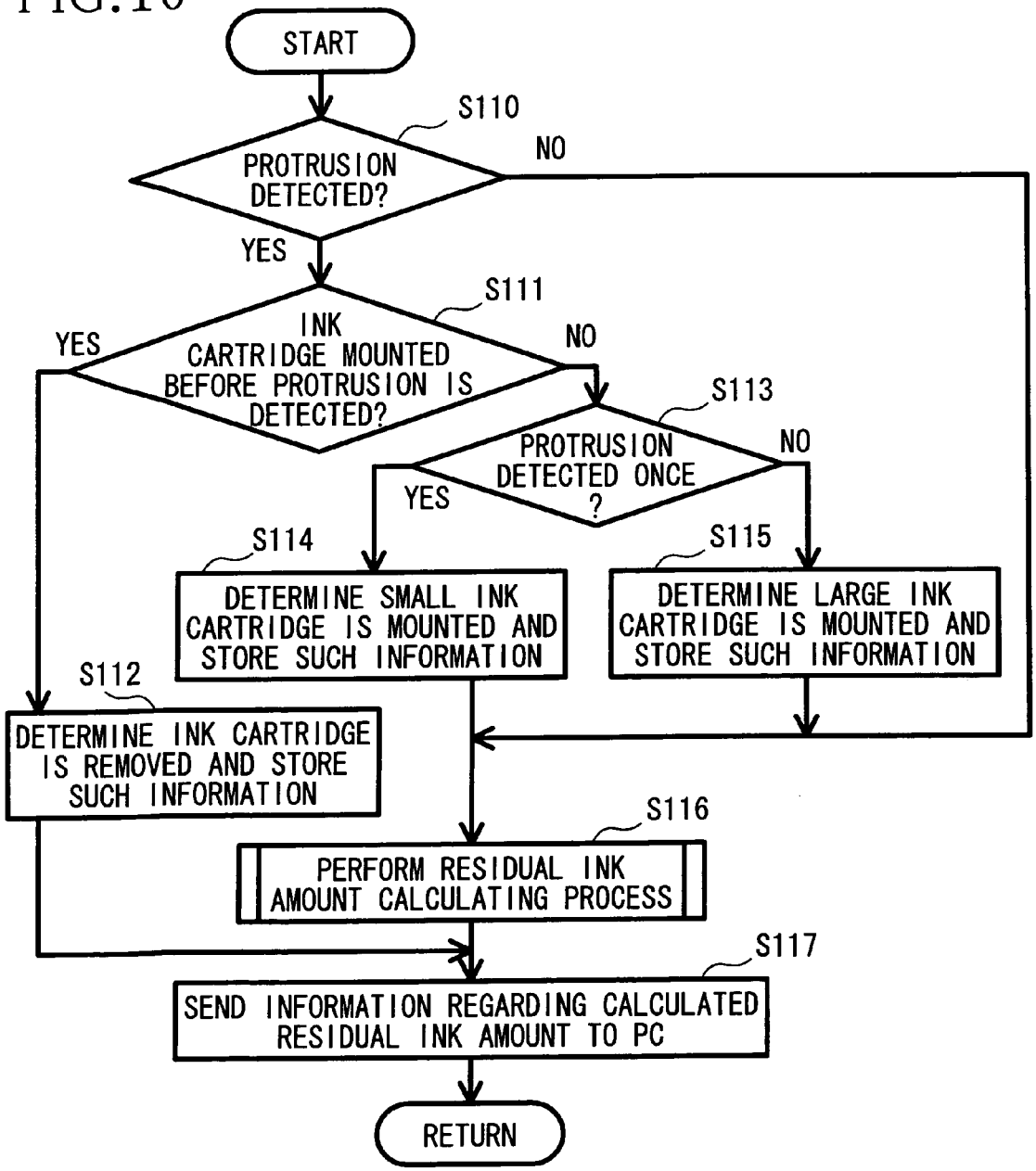
FIG. 10 is a flowchart showing an exemplary process according to this invention for detecting whether an ink cartridge is installed in an inkjet printer.

With reference to the flowchart in FIG. 10, operations of the ink cartridge detector 80 and the residual ink amount calculator 81 performed when the ink cartridge 3*d* or 3*d*' is removably mounted on/installed in the holder 4*d* will be described.

In the state where the inkjet printer 1 is turned on, when the protrusion 66 or 76 provided on the cap 24 is not detected by the sensor 14 (S110: NO), operation proceeds to S116 where a residual ink amount calculating process is performed. When the protrusion 66 or 76 is detected by the sensor 14 (S110: YES), operation proceeds to S111 where it is determined which of the ink cartridges 3*d* and 3*d*' is mounted on/installed in the holder 4 before the protrusion 66 or 76 is detected by the sensor 14 in step S110. When the ink cartridge 3*d* or 3*d*' is mounted on/installed in the holder 4 before the protrusion 66 or 76 is detected by the sensor 14 (S111: YES), it is determined that the ink cartridge 3*d* or 3*d*' is removed from the holder 4 and such information is stored in the control device 8, in step S112. Then, operation returns to START, because the residual ink amount does not have to be calculated.

When the ink cartridge 3*d* or 3*d*' is not mounted on/installed in the holder 4 before the protrusion 66 or 76 is detected by the sensor 14 (S111: NO) and the protrusion 66 is detected once (S113: YES), it is determined that the small ink cartridge 3*d* is mounted on/installed in the holder 4*d* and such information is stored in the control device 8, in step S114. Then, operation proceeds to S116 where the residual ink amount calculating process is performed. When the ink cartridge 3*d* or 3*d*' is not mounted on/installed in the holder 4*d* before the protrusion 66 or 76 is detected by the sensor 14 (S111: NO) and the protrusion 76 is detected twice, that is, the detection portions 76*a*, 76*b* are detected (S113: NO), it is determined that the large ink cartridge 3*d*' is mounted on/installed in the holder 4 and such information is stored in the control device 8, in step S115. Then, operation proceeds to S116 where the residual ink amount calculating process is performed.

In the residual ink amount calculating process S116, when the residual ink amount in the ink chamber 31 is sufficient and the light shielding plate 60 of the shutter mechanism 23 is detected by the sensor 14, the residual ink amount in the ink chamber 31 is estimated, based on the maximum ink containable capacity of the ink cartridge 3*d* or 3*d*', which is different between the ink cartridges 3*d* and 3*d*', and the total number of ink droplets ejected since the ink cartridge 3*d* or 3*d*' is mounted on/installed in the holder 4. When the residual ink amount in the ink chamber 31 is small and the light shielding plate 60 of the shutter mechanism 23 is not detected by the sensor 14, the residual ink amount in the ink chamber 31 is more precisely calculated, based on the residual ink amount at the time when the light shielding plate 60 becomes undetected by the sensor 14 and the total number of ink droplets ejected from the time the light shielding plate 60 becomes undetectable by the sensor 14. Information regarding the residual ink amount calculated in step 116 is sent to the PC 82 in step 117 and operation returns to START.

Information regarding whether the ink cartridge 3*d* or 3*d*' is mounted on/installed in the holder 4*d*, if mounted, which ink cartridge 3*d* or 3*d*' is mounted on/installed in the holder 4*d*, and the number of ink droplets ejected, is stored in the non-volatile memory, such as EEPROM, to maintain the information after the inkjet printer 1 is turned off.

The non-light permeable protrusion 66 or 76 formed on the cap 24 and the light shielding plate 60 disposed in the inner space of the protrusion 34 are provided along a mounting/installation direction of the ink cartridge 3. The protrusion 66 or 76 is positioned lower than the light shielding plate 60 (leading side of the ink cartridge 3 in the mounting/installation direction—toward a surface of the ink cartridge 3 that is first inserted into the cartridge holder 4 during installation of the ink cartridge 3 in the cartridge holder 4). Therefore, only when the ink cartridge 3 is mounted on/installed in or removed from the holder 4 does the sensor 14 for detecting the residual ink amount detect the protrusion 66 or 76, so the ink cartridge detector 80 can determine whether ink cartridge 3 is mounted on/installed in the holder 4 and, if mounted, which ink cartridge 3*d* or 3*d*' is mounted on/installed in the holder 4*d*. Thus, a detector for detecting whether the ink cartridge 3 is mounted on/installed in the holder 4 and if mounted/installed, which ink cartridge 3*d* or 3*d*' is mounted/installed, does not have to be separately provided from the sensor 14. Thus, production costs can be reduced. The protrusion 66 or 76 is detected by the sensor 14 only when the ink cartridge 3 is mounted on/installed in or removed from the holder 4 in one direction. Therefore, complicated operations for detecting the protrusion 66 or 76 by the sensor 14 are not required. Further, breakage of the exposed protrusions 66, 76, which may be lower in structural strength than the protrusion 34, for example by contacting the holder 4 when the ink cartridge 3 is mounted/installed, can be prevented.

The small ink cartridge 3*d* and large ink cartridge 3*d*' containing black ink have the protrusions 66, 76, respectively, whose shapes are different from each other. Accordingly, the ink cartridge detector 80 can determine, using the protrusions 66, 76, whether the ink cartridge 3*d*, 3*d*' is mounted on/installed in the holder 4*d* and if mounted/installed, which ink cartridge 3*d* or 3*d*' is mounted/installed. Based on the type of the ink cartridge 3*d* or 3*d*' mounted on/installed in the holder 4*d*, which is detected by the ink cartridge detector 80, the residual ink amount calculator 81 precisely calculates the residual ink amount in the ink cartridge 3.

Figure 11:
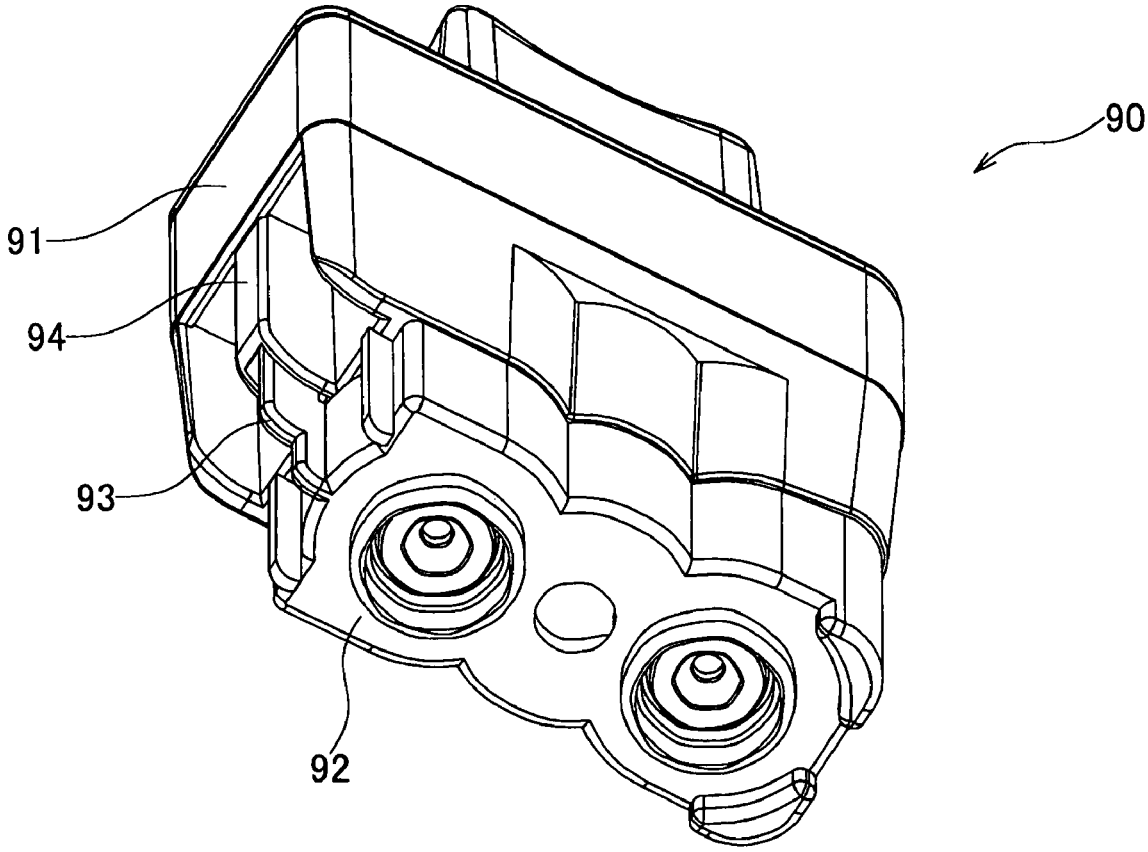
FIG. 11 is a perspective view of the bottom of an exemplary ink cartridge according to this invention.

To prevent the protrusion 66 or 76 from being damaged when the ink cartridge 3 is mounted on/installed in or removed from the holder 4, the ink cartridge 3 may have a cover for covering at least a part of the protrusion 66 or 76. As shown in FIG. 11, an ink cartridge 90 includes a cartridge body 91 and a cap 92 having a protrusion 93 formed thereon. A cover 94 of a substantially rectangular column that extends vertically is provided on the cartridge body 91. An upper portion of the protrusion 93 is covered by or inserted into the cover 94. Thus, in the ink cartridge 90, the protrusion 93 is protected by the cover 94. Therefore, even if the protrusion 93 makes contact with the holder 4 when the ink cartridge 90 is mounted on/installed in the holder 4, the protrusion 93 is not likely to be damaged. The protrusion 93 may be entirely covered by a light permeable cover. Thus, damage to the protrusion 93 can further be prevented.

The cartridge body 20, 70, 91 and the cap 24, 71, 92 may be integrally formed. Thus, the number of components to be used for the ink cartridge 3, 90 can be reduced. In addition, an assembly process for attaching the cap 24, 71, 92 to the cartridge body 20, 70, 91 can be eliminated, so that a reduction in production costs can be achieved.

A sensor for detecting the residual ink amount in the ink cartridge 3, 90 is not limited to the optical sensor 14 that outputs a signal corresponding to whether the direct light from the light emitting portion 14*a* reaches the light receiving portion 14*b*, which is connected to the light emitting portion 14*a* by a substantially straight optical path. For example, an optical sensor that outputs a signal corresponding to whether light, which is emitted from a light emitting portion and reflected off a surface of a detected member, is received by a light receiving portion. In this case, an optical path for the light, which is substantially straightly emitted from the light emitting portion, may be temporarily blocked by a member having a predetermined reflectance. Indirect light reflected off the member in association with the reflectance is incident to the light receiving portion.

For example, the protrusion 66, 76, 93, which is used to detect whether the ink cartridge 3, 90 is mounted on/installed in the holder 4, may be formed of a light impermeable material having a predetermined reflectance. The optical sensor, which outputs a signal based on the reception or non-reception of the reflected light, may be arranged, in association with a mounting/installing or removing path of the ink cartridge 3, 90, such that the light receiving portion receives the indirect light, which is emitted from the light emitting portion and reflected off the protrusion 66, 76, 93, with a predetermined light intensity, when the ink cartridge 3, 90 is removably mounted on/installed in the holder 4. Thus, similar effects to those described above may be obtained. Further, a part of the cap 24, 71, 92 may have a predetermined reflectance. In this case, the light emitting portion and the light receiving portion of the optical sensor may not be disposed so as to face each other and the detection portion may not have to have a structure to block the optical path.

Similar to the protrusion 66, 76, 93 having a predetermined reflectance, the light shielding plate 60 may be structured to have a predetermined reflectance. Further, without using the light shielding plate 60, indirect light may be reflected using differences of reflectance of ink and a light permeable wall of the cartridge body 20, 70, 91. More specifically, in a condition where ink contacts the wall of the cartridge body 20, 70, 91, indirect light reflected off an interface between ink and the wall of the cartridge body 20, 70, 91 may be received by the light receiving portion. In a condition where ink runs out, the light passes through the wall of the cartridge body 20, 70, 91, so that the light may not be received by the light receiving portion. Thus, detectors for detecting the residual ink amount in the ink cartridge 3, 90 and whether the ink cartridge 3, 90 is mounted on/installed in the inkjet printer 1 may be combined with a relatively simple structure. Instead of the non-contact type optical sensor 14, a contact type sensor may be used.

The ink cartridge 3 is mounted on/installed in or removed from the holder 4, along one direction. The invention may be applied to such an ink cartridge that is mounted on/installed in or removed from the holder 4 by moving the ink cartridge in two or more directions, for example, by moving the ink cartridge first downwardly and then horizontally.

While this invention has been described in conjunction with the exemplary embodiments outlined above, various alternatives, modifications, variations, improvements and/or substantial equivalents, whether known or that are or may be presently unforeseen, may become apparent to those having at least ordinary skill in the art. Accordingly, the exemplary embodiments of the invention, as set forth above, are intended to be illustrative, not limiting. Various changes may be made without departing from the spirit and scope of the invention. Therefore, the invention is intended to embrace all known or later developed alternatives, modifications, variations, improvements and/or substantial equivalents.

What is claimed is:

1. An ink cartridge, comprising:

a first detection portion positioned on the cartridge so as to be detectable by a detector of an image forming apparatus when the ink cartridge is installed in the image forming apparatus; and a second detection portion positioned on the cartridge so as to be detectable by the detector during installation and removal of the ink cartridge into/from the image forming apparatus;

wherein the second detection portion is positioned apart from the first detection portion, at least a portion of the second detection portion located beyond the first detection portion in a direction of inserting the ink cartridge into the image forming apparatus during installation of the ink cartridge in the image forming apparatus.

2. The ink cartridge according to claim 1, wherein the first detection portion and the second detection portion are formed of materials capable of preventing light emitted by a light emitting portion of the detector from reaching a light receiving portion of the detector.

3. The ink cartridge according to claim 2, further comprising a cartridge body capable of holding ink, the cartridge body being formed at least in part of a material having permeability to light;

wherein:

the first detection portion is a light shielding plate formed of a material that is substantially impermeable to light; and the light shielding plate is movably provided in the cartridge body so as to change position in response to variations in an amount of ink in the cartridge body.

4. The ink cartridge according to claim 2, further comprising a cartridge body capable of containing ink and a cap that covers an end of the cartridge body that is first inserted into the image forming apparatus during installation of the ink cartridge in the image forming apparatus;

wherein the second detection portion is a protrusion that protrudes outwardly from a side surface of the cap, the protrusion being substantially impermeable to light.

5. A set of ink cartridges, comprising first and second ink cartridges according to claim 4, wherein:

a first maximum ink capacity of the first ink cartridge is different from a second maximum ink capacity of the second ink cartridge; and the protrusion of the first ink cartridge differs in shape from the protrusion of the second ink cartridge.

6. The ink cartridge according to claim 4, wherein the cartridge body and the cap are separate members.

7. The ink cartridge according to claim 4, further comprising a cover for covering at least a part of the protrusion.

8. An image forming apparatus, comprising:

a cartridge mounting portion capable of mounting an ink cartridge including a first detection portion and a second detection portion;

a detector capable of detecting the first detection portion when the ink cartridge is installed in the image forming apparatus and detecting the second detection portion during installation and removal of the ink cartridge into/from the image forming apparatus; and a control device that calculates a residual ink amount in the ink cartridge based on detection of the first detection portion by the detector, and determines whether the ink cartridge is mounted on the cartridge mounting portion based on whether the second detection portion is detected by the detector.

9. An ink cartridge, comprising:

an ink tank capable of containing ink;

an ink supply passage through which ink in the ink tank can be selectively supplied to a location outside of the ink tank, the ink supply passage being capable of engaging with a connecting tube for supplying ink to a print head in an image forming apparatus when the ink cartridge is installed in the image forming apparatus;

a first protrusion provided on an outer wall of the ink cartridge, the first protrusion extending along the outer wall in a direction in which ink is supplied to a location outside of the ink tank; and a second protrusion provided on an outer wall of the ink cartridge, the second protrusion extending along the outer wall in the direction in which ink is supplied to a location outside of the ink tank, and being formed from a material that is substantially impermeable to light;

wherein:

at least a part of the first protrusion is positioned on the ink cartridge so as to be interposed between a light emitting portion and a light receiving portion of a through-beam sensor provided in the image forming apparatus, when the ink cartridge is installed in the image forming apparatus; and at least a part of the second protrusion is positioned on the ink cartridge so as to pass between the light emitting portion and the light receiving portion during installation and removal of the ink cartridge into/from the image forming apparatus.

10. The ink cartridge according to claim 9, wherein at least a part of the first protrusion is capable of having a first state in which the part is substantially impermeable to light and a second state in which the part is permeable to light.

11. The ink cartridge according to claim 9, comprising a second outer wall disposed parallel to the outer wall, wherein the first protrusion is formed only on the outer wall.

12. The ink cartridge according to claim 9, further comprising a first rib and a second rib positioned on the outer wall such that the first protrusion is interposed between the first rib and the second rib.

13. The ink cartridge according to claim 9, wherein a first width of the first protrusion and a second width of the second protrusion are smaller than a distance between the light emitting portion and the light receiving portion.

14. The ink cartridge according to claim 9, wherein the second protrusion is smaller in width than the first protrusion.

15. The ink cartridge according to claim 14, wherein the second protrusion is a thin plate member that is substantially impermeable to light.

16. The ink cartridge according to claim 9, wherein a first length of the first protrusion in a direction perpendicular to the direction in which ink is supplied to a location outside of the ink tank is greater than a second length of the second protrusion in a direction perpendicular to the direction in which ink is supplied to a location outside of the ink tank.

17. The ink cartridge according to claim 9, wherein the ink supply passage is provided with a valve member that opens the ink supply passage when the ink supply passage is engaged with the connecting tube.

18. An inkjet printer, comprising:

a print head capable of ejecting ink onto a recording medium; and a cartridge mounting portion capable of mounting an ink cartridge including a first protrusion, a second protrusion, and an ink supply passage, the cartridge mounting portion including:

a through-beam sensor having a light emitting portion and a light receiving portion; and a connecting tube for supplying ink in the ink cartridge to the print head;

wherein the cartridge mounting portion is configured so that:

during installation of the ink cartridge in the inkjet printer, the second protrusion passes between the light emitting portion and the light receiving portion before the first protrusion;

when the cartridge is installed in the inkjet printer, at least a part of the first protrusion is interposed between the light emitting portion and the light receiving portion and at least a part of the connecting tube is engaged with the ink supply passage; and during removal of the ink cartridge from the inkjet printer, the second protrusion passes between the light emitting portion and the light receiving portion after the first protrusion is moved away from a position between the light emitting portion and the light receiving portion.

19. An ink cartridge, comprising:

a cartridge body defining an ink chamber therein;

a translucent portion provided on the cartridge body, wherein the translucent portion has an inner space formed therein and the inner space communicates with the ink chamber, a movable member comprising a first light shielding portion, wherein the first light shielding portion is provided within the inner space of the translucent portion and the movable member is movable in response to a change in an amount of ink in the ink chamber; and a second light shielding portion, wherein the first light shielding portion and second light shielding portion are separate members and are aligned in a first direction.

20. An ink cartridge according to claim 19, further comprising a communication chamber extending in the first direction from the ink chamber toward an exterior of the ink cartridge.

21. An ink cartridge according to claim 20, further comprising a valve provided in the communication chamber.

22. An ink cartridge according to claim 19, wherein the translucent portion protrudes from an outer wall of the cartridge body and extends in the first direction.

23. An ink cartridge according to claim 19, wherein each of the translucent portion and the second light shielding portion protrudes from an outer wall of the ink cartridge and extends in the first direction.

24. An ink cartridge according to claim 19, wherein a first length of the translucent portion in a second direction that is perpendicular to the first direction is greater than a second length of the second protrusion in the second direction.

25. An ink cartridge according to claim 19, wherein:

the movable member further comprises a float;

the first light shielding portion is provided at a first end of the movable member and the float is provided at a second end of the movable member opposite from the first end; and the movable member is pivotally supported at a location between the first light shielding portion and the float.

26. The ink cartridge according to claim 19, further comprising a cap covering an end of the cartridge body, wherein the second light-shielding portion is provided on the cap.

27. The ink cartridge according to claim 19, wherein the translucent portion is a protrusion protruding from an outer wall of the cartridge body.

28. The ink cartridge according to claim 27, wherein a first length of the protrusion in a second direction that is perpendicular to the first direction is greater than a second length of the second light-shielding portion in the second direction.

29. A set of ink cartridges, comprising first and second cartridges according to claim 19, wherein:

a first ink capacity of the first ink cartridge is different from a second ink capacity of the second ink cartridge; and the second light-shielding portion of the first ink cartridge differs in shape from the second light-shielding portion of the second ink cartridge.

* * * * *